US005240184A

United States Patent [19]

Lawson

[11] Patent Number: 5,240,184

[45] Date of Patent: Aug. 31, 1993

[54] SPREADER NOZZLE FOR IRRIGATION SPRINKLERS

[75] Inventor: Kenneth L. Lawson, Rancho Cucamonga, Calif.

[73] Assignee: Anthony Manufacturing Corp., Azusa, Calif.

[21] Appl. No.: 876,062

[22] Filed: Apr. 28, 1992

[51] Int. Cl.[5] ..... B05B 1/02; B05B 3/04

[52] U.S. Cl. ..... 239/499; 239/518; 239/590; 239/550; 239/237

[58] Field of Search ..... 239/237, 240, 242, 600, 239/590, 461, 499, 518, 550, 553

[56] References Cited

U.S. PATENT DOCUMENTS

| | | | |
|---|---|---|---|
| Re. 23,646 | 4/1953 | Burdick | 239/240 |
| 1,827,961 | 10/1931 | Thompson | 239/590 |
| 2,393,091 | 1/1946 | De Lacy-Mulhall | 239/242 |
| 3,022,012 | 2/1962 | Sharp et al. . | |
| 3,149,784 | 9/1964 | Skidgel | 239/240 |
| 3,334,817 | 8/1967 | Miller et al. | 239/242 |
| 4,182,494 | 1/1980 | Wichman . | |
| 4,538,763 | 9/1985 | Perry et al. | 239/600 |
| 4,681,259 | 7/1987 | Troup et al. . | |
| 5,086,977 | 2/1992 | Kah, Jr. . | |
| 5,104,045 | 4/1992 | Kah, Jr. . | |

*Primary Examiner*—Andres Kashnikow
*Assistant Examiner*—Christopher G. Trainor
*Attorney, Agent, or Firm*—Kelly, Bauersfeld & Lowry

[57] ABSTRACT

An irrigation sprinkler nozzle for enhancing the distribution of close-in watering comprising a nozzle housing housing an inlet opening and an outlet opening with a tortious pathway therebetween for inducing turbulence into the water stream to produce a low pressure, small droplet size water spray.

10 Claims, 4 Drawing Sheets

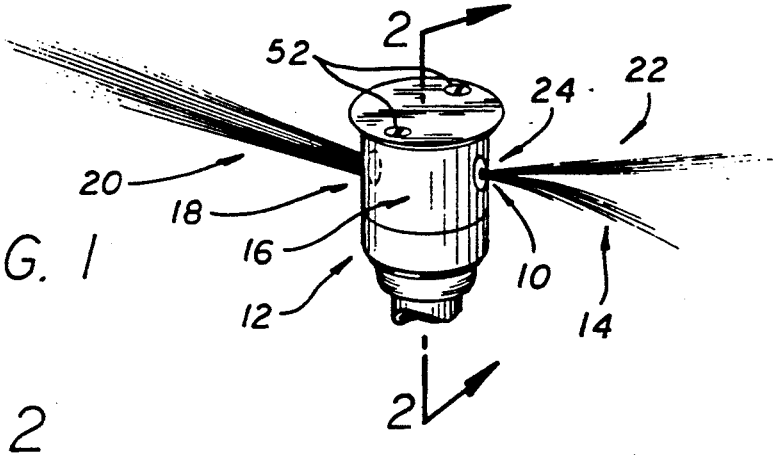
FIG. 1
FIG. 2
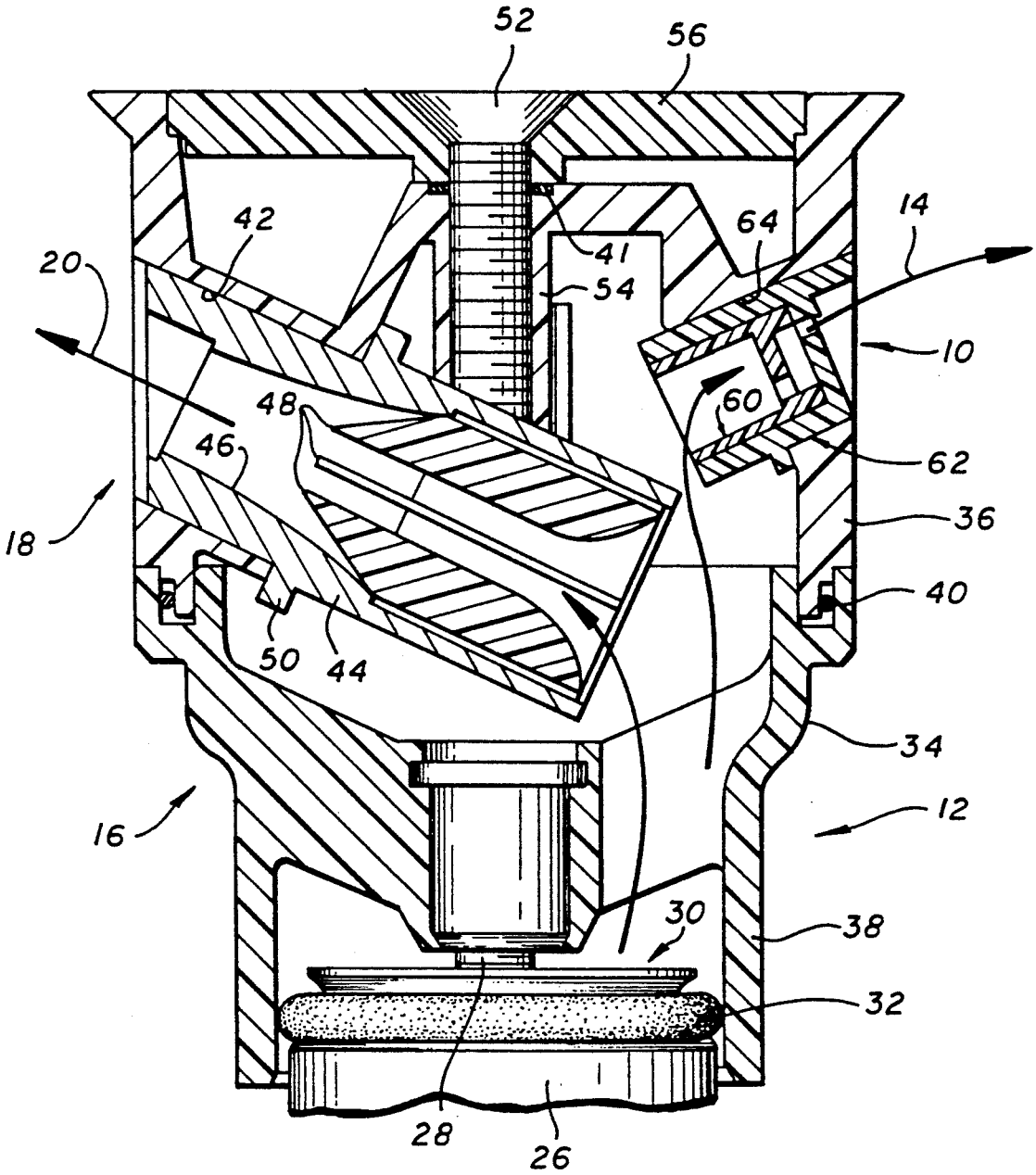

FIG. 6
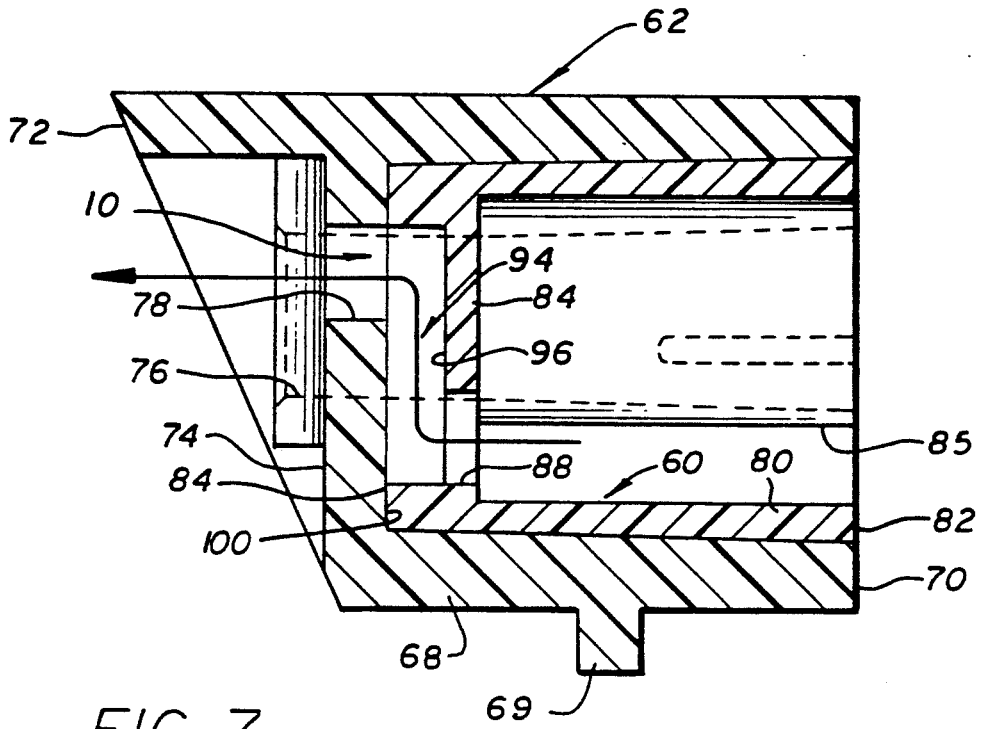
FIG. 7
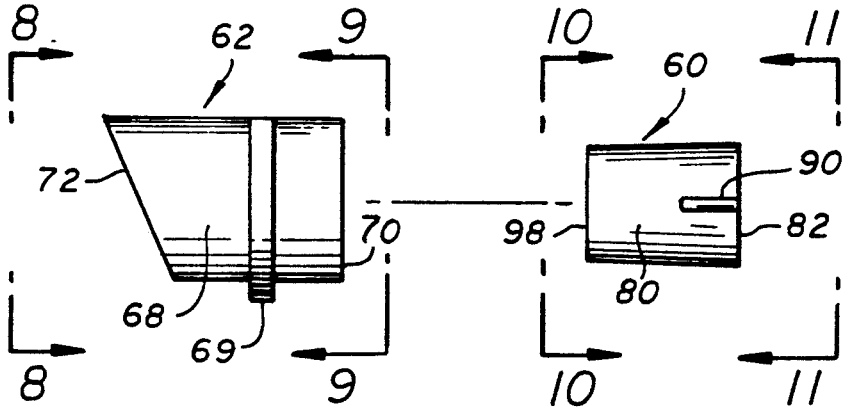
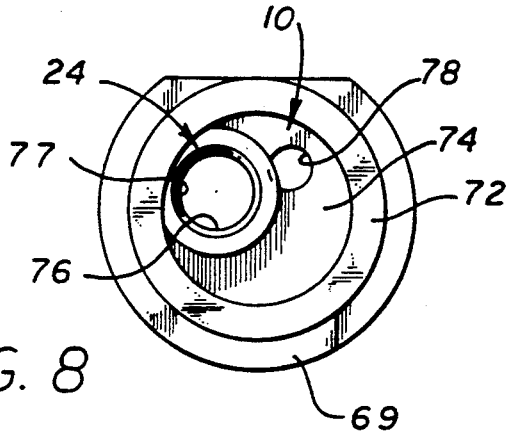
FIG. 8
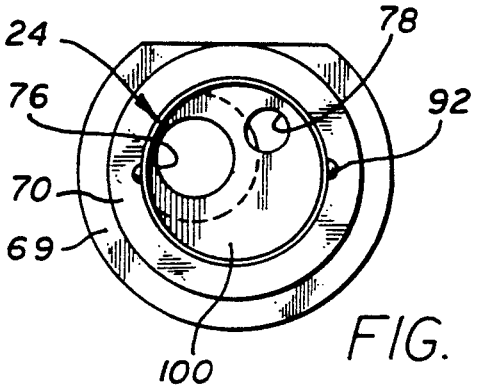
FIG. 9

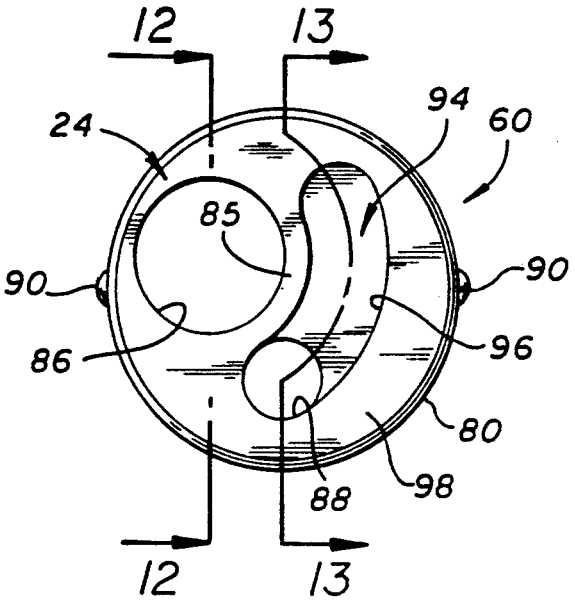
FIG. 10
FIG. 11
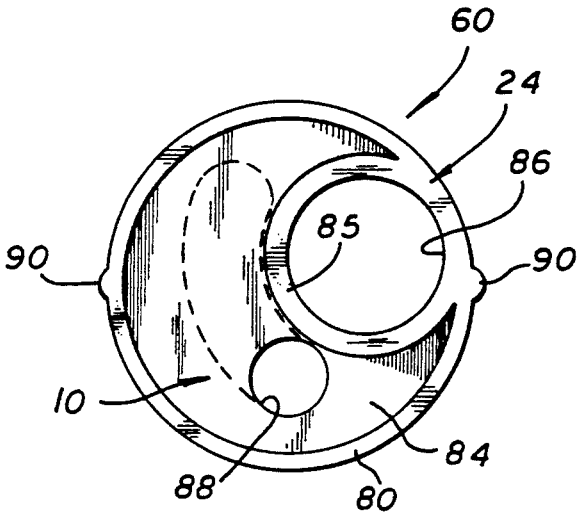
FIG. 12
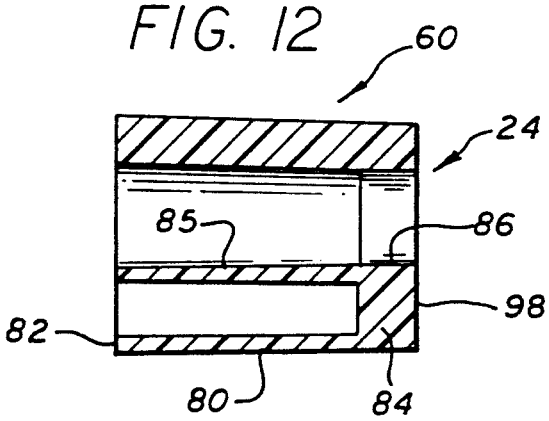
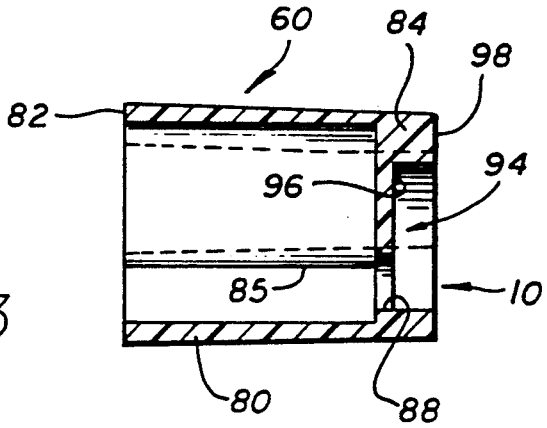
FIG. 13

SPREADER NOZZLE FOR IRRIGATION SPRINKLERS

BACKGROUND OF THE INVENTION

This invention relates to irrigation sprinklers, and more particularly to a new and improved short range sprinkler nozzle intended to produce a low pressure, small droplet sized water spray for close-in watering.

Many large size sprinklers employ multiple nozzles for projecting water sprays different distances from the sprinkler to more uniformly water the area intended to be covered by the sprinkler. Typically, such sprinklers may employ a relatively large bore or "range" nozzle which can project a relatively high velocity, large volume water stream fifty to a hundred feet or more from the sprinkler, and a short range or "spreader" nozzle which is intended to project a smaller volume water stream a shorter distance from the sprinkler to irrigate the area between the area covered by the range nozzle and the sprinkler body. In some instances, such sprinklers may also employ a third, intermediate range nozzle for projecting a stream an intermediate distance to cover an area between that covered by the range nozzle and that covered by the spreader nozzle.

In conjunction with the use of a spreader nozzle, it is important that the stream produced fall-out early and uniformly to enhance water distribution, and that the size of the water droplets be relatively small to prevent the irrigated soil from being compacted by the falling water drops. Typically, such spreader nozzles have employed the techniques of producing a high pressure and/or high velocity water stream from the nozzle which cause the stream to expand rapidly upon exiting the nozzle and thereby produce a fine spray of relatively small size droplets.

While spreader nozzles employing such techniques have met with considerable success, one problem that has long been present is that the fine, almost mist-like spray produced by many spreader nozzles is susceptible to being blown by wind, and suffers from considerable evaporation before reaching the ground. As will become apparent hereinafter, the present invention provides a short range or spreader nozzle which minimizes the effects of wind and evaporation while providing a highly reliable and effective means for producing a low pressure, small droplet sized spray for close-in watering.

SUMMARY OF THE INVENTION

The present invention provides a spreader nozzle formed in such a manner to provide a controllable tortions pathway through the nozzle to induce turbulence and reduce stream energy. The spreader nozzle of the invention is relatively simple in design and economical to manufacture, yet is highly reliable and effective in use and can be formed to produce substantially any level of energy dissipation for the resultant spray.

The spreader nozzle is herein formed as a composite two part assembly comprising a cylindrical nozzle casing and a cylindrical nozzle insert, and which together define a tortions pathway through which water travels from the nozzle inlet to the outlet opening. In this instance, the tortuous pathway is formed by an arcuate passageway interconnecting a water inlet opening in the nozzle insert with a water outlet orifice in the casing, the water flow being turned through two successive substantially ninety degree angles between the inlet opening and an outlet orifice. The tortious passageway is formed by an arcuate channel in the outer face of an end wall of the insert and which is closed by the inner face of a transverse endwall formed in the casing.

As water passes through the inlet opening in the insert, it is initially turned through a first substantially ninety degree angle into the arcuate passageway, and, after flowing through the elongated arcuate passageway, is re-turned through a second substantially ninety degree angle to flow through the outlet orifice. Each turn of the water results in turbulence being induced into the stream, thereby reducing stream pressure. Further, as the water flows through the arcuate passageway between the inlet opening and outlet orifice, wall friction acts on the flow to further reduce stream energy, by selecting the inlet opening size in the insert, and the cross-sectional size, length and roughness of the arcuate passageway, the amount of stream energy reduction can be selected and controlled so that spreader nozzle performance can be controlled to match the performance of the range nozzle and, if applicable, intermediate range nozzle to enhance distribution and promote uniformity of the water pattern produced by the sprinkler.

The many features and advantages of the present invention will become more apparent from its following detailed description taken in conjunction with the accompanying drawings which disclose, by way of example, the principle of the invention.

BRIEF DESCRIPTION OF THE DRAWINGS

FIG. 1 is a perspective view of a rotary sprinkler having a new and improved spreader nozzle embodying the principles of the present invention;

FIG. 2 is an enlarged, fragmentary cross-sectional view of a sprinkler nozzle assembly taken along line 2—2 of FIG. 1;

FIG. 6 is an enlarged cross-sectional view taken substantially along the line 6—6 of FIG. 4;

FIG. 7 is an exploded side elevation view similar to FIG. 3 but of reduced size;

FIG. 8 is an enlarged front elevated view taken substantially along the line 8—8 of FIG. 7;

FIG. 9 is an enlarged rear elevational view taken substantially along the line 9—9 of FIG. 7;

FIG. 10 is an enlarged front elevational view taken substantially along the line 10—10 of FIG. 7;

FIG. 11 is an enlarged rear elevational view taken substantially along the line 11—11 of FIG. 7;

FIG. 12 is a reduced size cross-sectional view taken substantially along the line 12—12 of FIG. 10; and FIG. 13 is a reduced size cross-sectional view taken substantially along the line 13—13 of FIG. 10.

DETAILED DESCRIPTION OF THE PREFERRED EMBODIMENT

Figure 3:
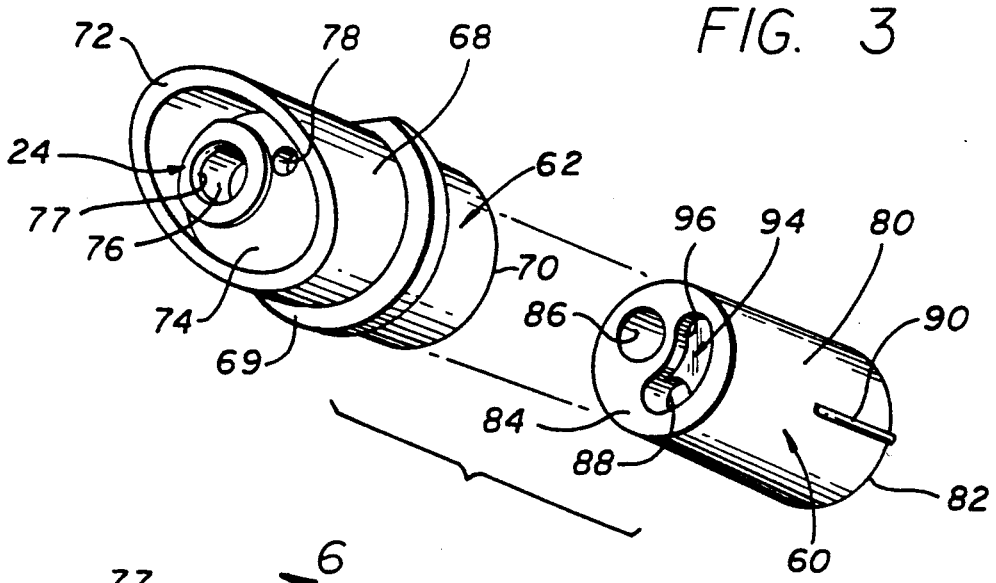
FIG. 3 is a further enlarged exploded perspective view of a spreader nozzle embodying the principles of the present invention.

As shown in the exemplary drawings, the present invention is embodied in a new and improved short range nozzle 10, hereinafter referred to as a spreader nozzle, for use with an irrigation sprinkler of conventional type, herein generally designated 12, the spreader nozzle being particularly adapted to produce a water stream 14 having a substantially reduced stream energy so as to promote early fall-out of relatively small sized water droplets. In this instance, the spreader nozzle 10 of the present invention is illustrated as being mounted in the cylindrical nozzle housing 16 of a rotary sprinkler 12 of the type which includes a second, relatively larger nozzle 18, typically referred to as a range nozzle, for projecting a relatively large volume, high pressure stream 20 of water outwardly from the sprinkler a substantially greater distance than that from the spreader nozzle 10, and includes a third intermediate range stream 22 projected from an intermediate range nozzle 24 formed as part of the spreader nozzle.

As shown in FIG. 2, the nozzle housing 16, typically formed from molded plastic, is mounted to the upper end of a suitable water operated motor (not shown) carried within a motor housing 26, the motor including a suitable drive shaft 28 attached to the nozzle housing 16 for rotatably coupling the nozzle housing to the motor. Pressurized water supplied to the sprinkler 12 from a suitable source (also not shown) passes through the motor and motor housing 26 and is admitted into the nozzle housing 16 through an annular opening 30 formed in the upper end of the motor housing. A suitable journal seal 32, herein an o-ring seal, is provided around the upper end portion of the motor housing 26 and functions to prevent water from escaping from the junction between the nozzle housing and motor housing.

To facilitate assembly, the nozzle housing 16 herein is formed of two components, a lower nozzle housing portion 34 and an upper nozzle housing portion 36, the upper nozzle housing portion serving as a mounting location for the range nozzle 18 and combined spreader nozzle 10 and intermediate range nozzle 24, and the lower housing portion serving to couple the nozzle housing to the drive shaft 28, and including a cylindrical skirt portion 38 which is rotatably yet sealingly engaged by the journal seal 32. For mounting the range nozzle 18 within the nozzle housing 16, the upper nozzle housing portion 36 herein has a downwardly inclined and radially inwardly opening cylindrical wall 42 forming a sleeve into which the range nozzle is inserted with a press-fit.

The range nozzle 18, also typically made of molded plastic, herein is formed with a cylindrical body 44 having a relatively large bore converging water passage 46 centrally therethrough, and is provided with radially projecting vanes 48 for straightening the water flow through the nozzle passageway to promote distance, as is well known in the art. An annular flange 50 projects outwardly around the body 44 and abuts the inner end of the cylindrical wall 42 of the upper nozzle housing portion 36 to locate and seat the range nozzle 18 within the nozzle housing 16. To secure the upper nozzle housing portion 16 to the lower housing portion 34, a pair of screws 52 herein are threaded through a pair of aligned cylindrical bosses 54 formed within the upper and lower nozzle housing portions, the screws also acting to secure a disc-shaped cover 56 over the nozzle housing. To seal the upper and lower housing portions 36 and 34, an o-ring seal 40 is provided at the junction between the two portions, and to seal the cover 56 to the nozzle housing 16, a further o-ring 41 is provided around each of the screws 52.

Figure 4:
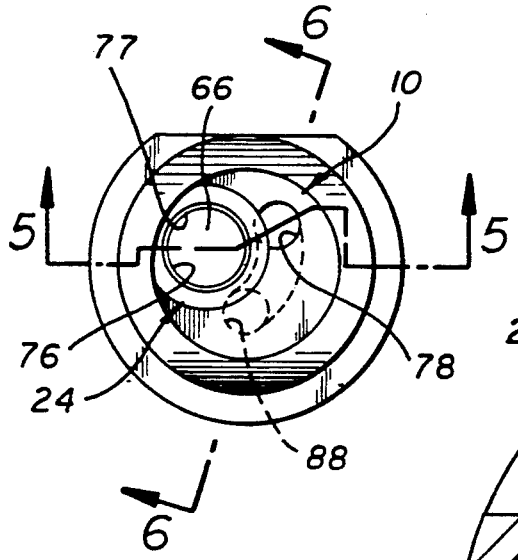
FIG. 4 is an enlarged front elevation view of the assembled spreader nozzle of FIG. 3.
Figure 5:
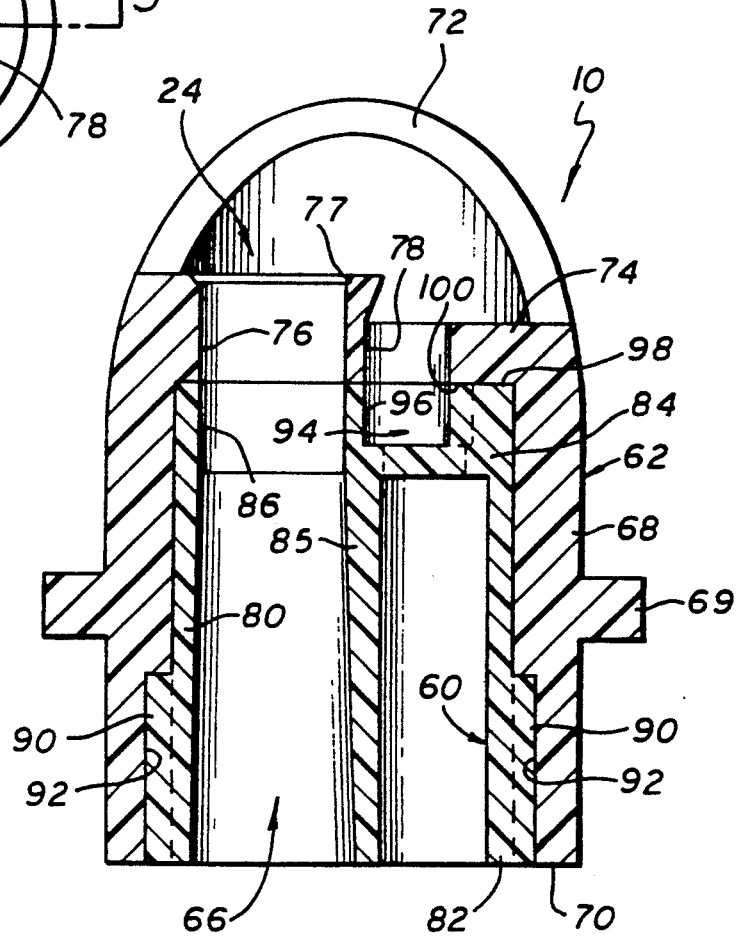
FIG. 5 is an enlarged cross-sectional view taken substantially along the line 5—5 of FIG. 4.

Disposed on the opposite side of the nozzle housing 16 from the range nozzle 18 is the spreader nozzle 10 of the present invention and its combined intermediate range nozzle 24. In this instance, as best seen in FIGS. 3 through 5, the combined spreader nozzle 10 and intermediate range nozzle 24 are formed by a two component assembly, each preferably made of molded plastic, comprising a generally tubular nozzle insert member 60 mounted within a generally tubular nozzle casing 62, the casing being herein secured within a downwardly and inwardly extending cylindrical sleeve 64 formed in the nozzle housing 16. As best seen in FIG. 5, the intermediate range nozzle 24 is basically a straight bore nozzle formed by a cylindrical passageway 66 extending through the nozzle insert 60 and nozzle casing 62, the intermediate range nozzle serving to produce a water stream 22 which is projected outwardly a greater distance than the stream 14 from the spreader nozzle 10, but not as far as the stream 20 from the range nozzle 18, thereby to provide a relatively uniform irrigation pattern outwardly from the sprinkler. The use of such an intermediate range nozzle 24 is particularly helpful with sprinklers having very large range nozzles 18, such as are typically used for the irrigation of large areas like golf course fairways and municipal parks, but, as will become more apparent hereafter, is not necessary for accomplishing the principles of the present invention.

Herein, the nozzle casing 62 is formed by a cylindrical body 68 having an entrance end 70 and an exit end 72, the body including a lateral wall 74 adjacent the exit end 72 through which are formed a relatively large diameter exit opening 76 having an outwardly flared end 77 defining the outlet for the intermediate range nozzle 24, and a relatively smaller diameter outlet orifice 78 defining the exit for the spreader nozzle 10 (see FIGS. 3, 4, and 5). Like the range nozzle 18, the nozzle casing 62 is herein provided with an enlarged diameter annular flange 69 which is adapted to abut and locate the inner end of the cylindrical sleeve 64 in the nozzle housing 16, the outer end 72 having an inclined edge so that the outer end will be flush with the sidewall of the upper housing portion 36.

Similarly, the nozzle insert 60 is formed as a cylindrical body 80 adapted to frictionally mate within the nozzle casing 62 and having an entrance end 82 and a generally closed outlet end defined by a relatively thick end wall 84. Formed within the insert 60 is a cylindrical wall 85 defining the intermediate range nozzle passageway 66 in the insert, the end wall 84 having a relatively large diameter opening 86 aligned with the exit opening 76 in the casing 62. Also formed in the end wall 84 of the insert 60 is a relatively smaller opening 88 forming an inlet for the spreader nozzle 10 of the invention. In this instance, the nozzle insert 60 is provided with a pair of asymmetrical ribs or keys 90 projecting outwardly from opposite sides of the body 80, and which are adapted to mate with corresponding recesses or keyways 92 formed in the casing 62 to facilitate proper alignment of the insert within the casing.

In accordance with the present invention, the spreader nozzle 10 is formed in such a manner as to provide a controllable tortious pathway through the nozzle to thereby increase turbulence in the water stream and reduce water stream pressure and velocity. By reducing stream pressure and velocity, the spreader nozzle 10 can be formed to produce a controlled spray pattern which will fall-out as a gentle, small droplet size low energy spray relatively close to the sprinkler for close-in watering. Moreover, the spreader nozzle 10 of the invention is highly reliable and effective in use, yet is economical to manufacture and relatively simple in design and can be formed to produce substantially any desired level of energy dissipation for the resultant spray.

Toward the foregoing ends, as can best be seen in FIGS. 10 through 13, the spreader nozzle 10 herein provides a tortious pathway formed by the nozzle inlet opening 88 in the endwall 84 of the nozzle insert 60 and which leads to an arcuate, laterally disposed elongated passageway portion 94 communicating with the outlet orifice 78 formed in the lateral wall 74 of the nozzle casing 62. The arcuate passageway 94 is herein formed by an outwardly opening arcuate groove or channel herein having smooth sidewalls 96 in the outer face 98 of the end wall 84, and which is closed by the inner face 100 of the lateral wall 74 of the nozzle casing 62 to form a closed passageway extending between the inlet opening 88 of the insert and the outlet orifice 78 of the casing. Water entering the inlet opening 88 to the spreader nozzle 10 is thus turned through an initial substantially ninety degree angle as it moves into the arcuate passageway 94, and is then re-turned through another substantially ninety degree angle as it moves from the arcuate passageway through the outlet orifice 78. In this manner, turbulence is introduced into the stream as it is turned into and out of the passageway 94, and friction created by the sidewalls of the channel 96 act on the water as it passes through the tortuous pathway of the spreader nozzle 10, thereby to reduce the energy of the water flow by slowing its velocity and reducing its pressure.

More specifically, as water enters the inlet opening 88 and is turned into the passageway 94, turbulence is induced into the water flow which results in a reduction in the stream pressure. As the water flows through the passageway 94, friction is created on the stream by the sidewalls defined by the channel 96 in the outer face 98 of the insert 84 and the overlying adjacent inner face 100 of the casing 62 and which slows the water flow and further reduces stream pressure. Upon turning of the stream from the passageway 94 to the outlet orifice 78, further turbulence is created, thereby still further reducing stream pressure and velocity. By selecting the size of the inlet opening 88 in the nozzle insert 84, as well as the cross-sectional size and length of the passageway 94, the energy of the water stream ejected from the outlet orifice 78 of the spreader nozzle 10 can be controlled to produce the desired spray pattern and droplet size.

The smaller the diameter of the inlet opening 88, the greater the amount of turbulence that will be created in the stream as it passes through the inlet and is turned into the passageway 94. Since the creation of turbulence in the flow reduces stream pressure, the size of the inlet opening 88 can be selected and controlled to produce a desired pressure reduction at this initial point in the flow through the spreader nozzle 10. By turning the flow from the inlet opening 88 into the passageway 94, further turbulence can be induced into the stream, thereby further reducing stream pressure.

Similarly, the smaller the cross-sectional size of the passageway 94, the greater will be the effect of friction on the flow to reduce stream energy. Moreover, the relative roughness of the sidewalls 96 of the passageway 94, as well as its length can each be controlled to reduce stream energy since increases in roughness and length each act to increase friction in the flow.

Thus, by controlling the size of the inlet opening 88, the angle through which the stream is turned into the passageway 94, together with the length, roughness and cross-sectional size of the passageway, stream energy can be reduced to substantially any desired level to produce a small droplet size spray of low energy water. This, in turn, can be used to increase the uniformity of water distribution from the sprinkler 12 since the spreader nozzle operating parameters can be selected to match the parameters of the streams produced by the range nozzle 18 and, if applicable, the intermediate range nozzle 24.

From the foregoing, it should be appreciated that the present invention provides a new and improved spreader nozzle construction for use with an irrigation sprinkler which is relatively simple in design yet highly reliable and effective in use to produce a relatively low pressure, small droplet size spray for enhanced close-in watering distribution. While a particular form of the invention has been illustrated and described, it should also be apparent that various changes and modifications therein can be made without departing from the spirit and scope of the invention.

I claim:

1. In combination with an irrigation sprinkler of the type having a primary range nozzle for ejecting a relatively high pressure, large droplet size stream outwardly from the sprinkler, and a secondary spreader nozzle for ejecting a relatively low pressure, small droplet size spray outwardly from the sprinkler for close-in watering, said spreader nozzle comprising:

a housing mounted to said sprinkler and having openings defining a water inlet and a water outlet through which said relatively low pressure, small droplet size spray is ejected, said housing comprising a generally cylindrical casing having a lateral wall closing one end thereof, said outlet opening being formed through said lateral wall; and a generally tubular insert fitted within said casing, said insert having an endwall through which said inlet opening is formed disposed against said lateral wall, and a groove formed in said endwall extending from said inlet opening to adjacent said outlet opening, said groove being closed by said lateral wall to define a closed channel forming an elongated tortuous pathway interconnecting said inlet with said outlet and through which water from said inlet must travel to said outlet, said tortuous pathway being formed to induce turbulence into the water passing therethrough between said inlet and said outlet.

2. The combination as set forth in claim 1 wherein said groove is an arcuate groove.

3. The combination as set forth in claim 2 wherein said casing and said insert are each formed of molded plastic.

4. The combination as set forth in claim 3 wherein said groove is formed to turn water passing through said inlet opening through an angle of at least about ninety degrees.

5. The combination as set forth in claim 3 wherein said groove is formed to turn water passing therethrough through two successive angles of approximately ninety degrees each between said inlet opening and said outlet opening.

6. In an irrigation sprinkler of the type having a nozzle housing coupled to a sprinkler body and having a water inlet opening for receiving pressurized water from a source and an outlet opening through which water from the source is ejected outwardly away from the sprinkler into the atmosphere, the improvement wherein said nozzle housing includes:

a generally cylindrical nozzle casing having a lateral wall closing one end thereof, said outlet opening being formed through said lateral wall; and a generally tubular insert fitted within said casing, said insert having an endwall disposed adjacent said lateral wall with said inlet opening being formed through said end wall, and a groove formed in said endwall extending from said inlet opening to adjacent said outlet opening, said groove being closed by said lateral wall to define a closed channel forming an elongated tortuous pathway means extending between said inlet and said outlet openings for inducing turbulence into the pressurized water passing from said inlet opening to said outlet opening such that said ejected water is a relatively low pressure, small droplet size spray.

7. The improvement as set forth in claim 6 wherein said groove is an arcuate groove.

8. The improvement as set forth in claim 7 wherein said casing and said insert are each formed of molded plastic.

9. The improvement as set forth in claim 8 wherein said groove is formed to turn water passing through said inlet opening through an angle of at least about ninety degrees.

10. The improvement as set forth in claim 8 wherein said groove is formed to turn water passing therethrough through two successive angles of approximately ninety degrees each between said inlet opening and said outlet opening.

* * * * *